United States Patent [19]

Sarda

[11] Patent Number: 4,991,539

[45] Date of Patent: Feb. 12, 1991

[54] MICROWAVE UNIT FOR THERMOGRAPHIC PRINTING

[76] Inventor: Jean L. Sarda, 25, Rue Pradier, 75019 Paris, France

[21] Appl. No.: 287,514

[22] Filed: Dec. 19, 1988

Related U.S. Application Data

[63] Continuation of Ser. No. 76,137, Jul. 21, 1987, abandoned.

[30] Foreign Application Priority Data

Jul. 28, 1986 [FR] France ..... 861877

[51] Int. Cl.[5] ..... B05C 1/16

[52] U.S. Cl. ..... 118/668; 118/46; 219/10.55 A

[58] Field of Search ..... 118/46, 641, 642, 643, 118/668, 695, 60, 671, 65, 676; 219/10.55 A, 388, 216; 355/3 FU, 14 FU

[56] References Cited

U.S. PATENT DOCUMENTS

| | | | |
|---|---|---|---|
| 2,560,903 | 7/1951 | Stiefel | 118/641 X |
| 2,603,180 | 7/1952 | Berndt | 118/46 |
| 3,161,529 | 12/1964 | Curme | 118/641 |
| 3,501,635 | 3/1970 | Sprunger et al. | 250/319 |
| 3,541,289 | 11/1970 | Smith | 219/10.55 A |
| 3,765,425 | 10/1973 | Stungis et al. | 219/10.55 X |
| 3,784,777 | 1/1974 | Soulier | 219/10.55 A |
| 4,161,644 | 7/1979 | Yanagawa et al. | 219/216 |
| 4,187,405 | 2/1980 | Püschner et al. | 219/10.55 A |
| 4,414,913 | 11/1983 | Sarda | 118/46 |
| 4,435,072 | 3/1984 | Adaohi et al. | 355/3 FU |
| 4,456,368 | 6/1984 | Isaka et al. | 355/3 FU |
| 4,482,239 | 11/1984 | Hosono et al. | 219/10.55 A |
| 4,542,980 | 9/1985 | Tajima | 355/3 U |
| 4,659,927 | 4/1987 | Tago et al. | 250/319 |

*Primary Examiner*—Willard E. Hoag
*Attorney, Agent, or Firm*—James E. Bradley

[57] ABSTRACT

A thermography machine for relief printing equipped with a microwave device comprising: a generator FIG. 2 13 whose transmission frequency may be 2.45 GHz feeding an applicator 14 scattering the microwave energy over the powder image to be melted, a movable short-circuit 15 adjusting the length of the applicator 14 to make it resonate at the frequency of the microwave generator (for example 2.45 GHz), a nonreturn device arranged between the generator 13 and the applicator 14 and an electronic device for automatic tuning of the applicator 14.

2 Claims, 2 Drawing Sheets

MICROWAVE UNIT FOR THERMOGRAPHIC PRINTING

This application is a continuation of application Ser. No. 076,137, filed July 21, 1987 and now abandoned.

The present invention relates to microwave transmitters intended to be applied to thermography machines for relief printing.

Thermography or relief printing is a known process. It makes it possible, starting with a typographical print, offset or otherwise, to produce a relief print imitating plate printing or stamping. .The relief conversion is simple and consists in sprinkling a freshly printed paper sheet with a powder which has the property of melting under the effect of heat and of forming a relief film after melting.

Only the moist ink retains the powder and the excess is continuously recovered. The "powdered" printed matter then passes through a tunnel oven where the printed and powdered substrate needs to withstand a high temperature of the order of 150° to permit the powder to melt and lose enough viscosity to spread and form a smooth relief film. At the exit of the tunnel oven a jet of cold air cools the paper and solidifies the viscous relief film to prevent the sheets from sticking together.

Automatic conversion into relief is carried out as follows: on leaving the printing press, the paper is received directly on conveyor belts and passes, in succession, under the powdering unit, inside the tunnel oven and over a final conveyor, to cool, before being received in a delivery box. The powders employed, which are glossy or matt, are transparent and retain their hues in print colors. Pigmented powders, on the other hand, produce a relief which corresponds to their pigment, whatever the print color.

The particle size of the powder employed determines the thickness of the relief layer. The coarser the powder, the higher the relief.

The machines which are in use at present restrict the possibilities of this process, because they have a certain number of defects, the chief of which are the following:

high cost of the relief conversion, due to a very high energy consumption. This defect is particularly noticeable in the case of high-weight cards such as cardboard, more or less pronounced yellowing, depending on the type of paper or card, partial destruction of the substrate fiber, making subsequent treatments such as folding, box forming, and the like very difficult, erratic losses in the size of the substrate, generally resulting in its shrinkage. Apart from other defects, this defect practically rules out the use of this process for printed matter intended for data microprocessing. In fact, the majority of printed matter of this type is intended to form sets of a certain number of superposed sheets, each of which works in register with all of those forming the set, costly cooling of the substrate, due to the fact that the conveyors must be long, to enable the fibrous mass, which is an excellent heat insulator, to remove a considerable part of the heat energy taken up when the temperature of the printed substrate is raised, and a machine which is very bulky because of the abovementioned defects.

At the present time, melting of the powder is carried out by means of tunnel ovens, most of which are made of heating elements which radiate infrared and are in most cases fed by electrical or gas systems. The wavelength of the radiation is generally between 2 and 10 μm. Melting of the powder is produced by the combination of infrared radiation and the raising of the air temperature inside the tunnel oven, which goes up to about 350° centigrade, depending on the oven.

The paperboard industry is generally concerned with printing sheets of cardboard, starting with a single format of 50×70 centimeters or quadruple format of 100×140 centimeters in basic weights of the order of 330 grams per square meter. The printing rates are approximately 6000 copies per hour.

To give an indication, the relief conversion in a single format of printed matter of this kind requires a machine whose general characteristics are as follows:

width of the tunnel oven passage: 75 centimeters,
power absorbed: 90 to 100 kilowatts,
length of the tunnel oven: 4 meters, and
length of the cooling conveyors: 4 to 5 meters.

In the case of a quadruple format of 100×140 centimeters, the width of the passage would be doubled and the oven power would be substantially quadrupled.

Summary of the Invention

The present invention is aimed at overcoming all the abovementioned defects and chiefly at considerably improving the energy balance of this relief conversion by replacing the conventional tunnel ovens with a microwave device whose performance enables the energy consumption to be divided by a factor of more than four in the case of 50×70 cm formats and by more than eight in the case of the quadruple formats, because the consumption is substantially the same over passage widths of between 50 and 150 cm.

Furthermore, since the heating of the substrate is, broadly, divided by a factor of three, the length of the cooling conveyors is proportionately shortened.

By way of example, without implying any limitation, a type of microwave device fitted to a thermography machine is described with reference to the attached drawings.

BRIEF DESCRIPTION OF THE DRAWINGS

FIG. 1 shows a front view of a conventional thermography machine equipped with a conventional tunnel oven 10, containing electrical heating elements or gas burners. In general outline, these machines consist of a supporting structure 1, FIG. 1, carrying all the conveyors for feeding 2 the printed matter, for powdering 3, for melting the powder 4 and for cooling 5. The printed matter 6 is received by the printing press 7 on the feed conveyor 2 and then on the powdering conveyor 3, where a layer of powder is discharged onto the printed matter by the powder trough 8. The cyclone 9 sucks away and recycles the excess powder which is not retained by the moist ink. The printed matter then passes onto the melting conveyor 4 inside the tunnel oven 10 and onto the conveyor for cooling by means of air driven by a turbine 11A, blowing inside the perforated casing 11. A delivery box 12 completes this assembly.

FIG. 2 shows a front view of the same machine, in which the tunnel oven 10 has been replaced with the microwave device 13-14-15, and the cooler casing 11 and its conveyor 5 have been shortened by virtue of the fact that a melting process using microwaves considerably reduces the heating of the printed matter.

FIG. 3 shows a more detailed perspective view of a microwave device, FIG. 2 and 3, 13-14-15, characterized in that it comprises a conventional microwave generator 13, FIG. 3, whose transmission frequency may be 2.45 GHz (a frequency especially allocated to industrial applications) and which feeds an applicator or wave guide 14 employed to scatter the microwave energy over the product to be melted 6 which is placed on the conveyor 4. The other end of the applicator ends in a movable short-circuit or end plate 15 so that the length of the applicator can be adjusted to make it resonate at the frequency of the microwave generator (for example 2.45 GHz). The choice of the shape and of the size of the applicator 14 permits the excitation of a particular mode of wave propagation which is such that the coupling between the wave and the product to be melted is optimized. The generator set 13, the applicator 14 and the movable short-circuit 15 forming the microwave device are fastened to the structure 1.

By way of an example which does not imply any limitation, an applicator 14 whose cross-section is a rectangle of 8.6×13 centimeters will be advantageously chosen, which allows it to be coupled to a standard guide 8.6×4.3 centimeters in size, by means of an iris whose coupling hole area permits an optimum coupling of the applicator 14 to the generator 13 when the applicator resonates. The electrical field in the applicator 14 is parallel to the side whose size is 13 centimeters. An automatic tuning device may be provided to permit automatic monitoring of the resonance tuning of the applicator 14.

Figure 1:
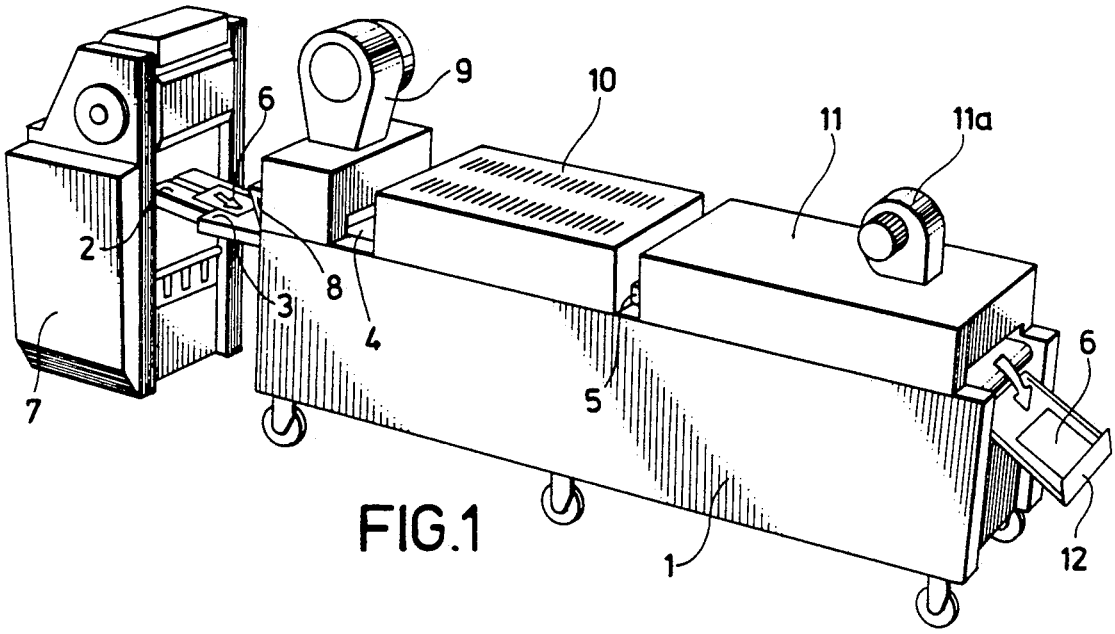
FIG. 1 is a perspective view of a prior art thermography machine.
Figure 2:
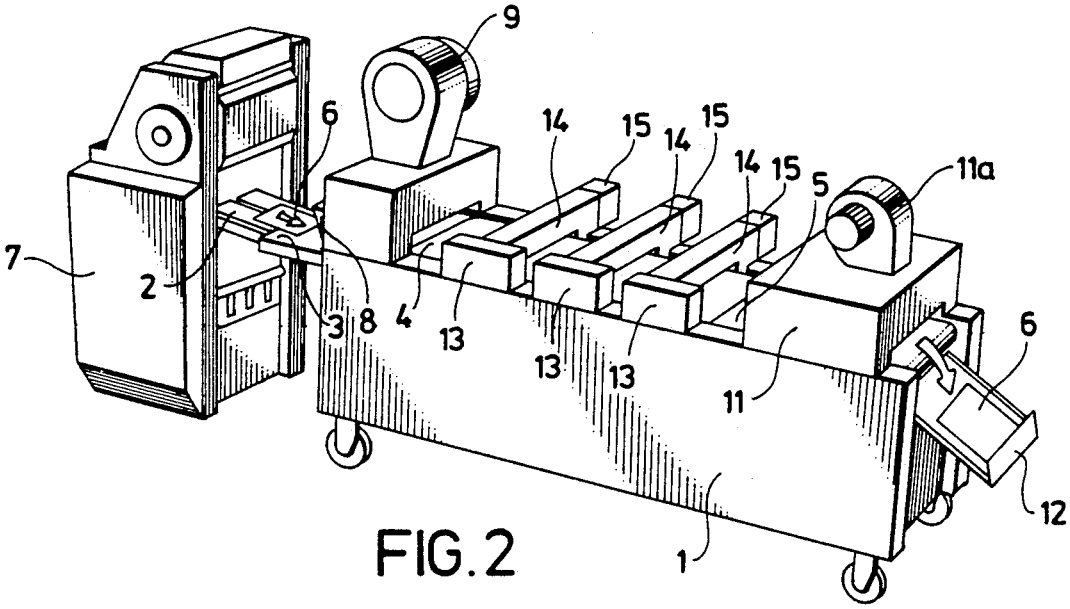
FIG. 2 is a perspective view of a thermography machine constructed in accordance with this invention.
Figure 3:
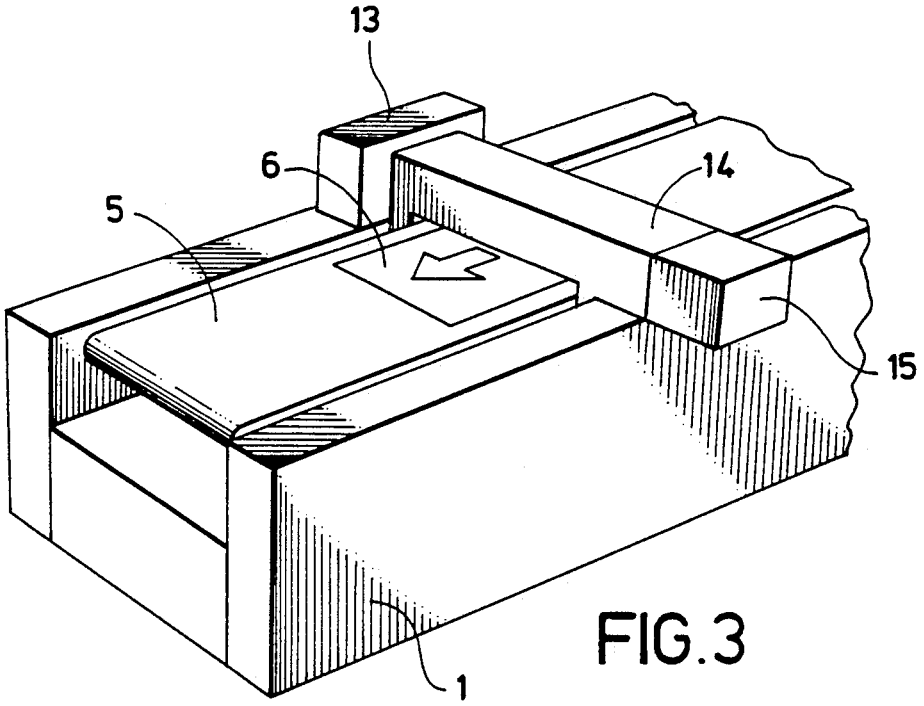
FIG. 3 is an enlarged perspective view illustrating one of the microwave units for the thermography machine of FIG. 2.

When the applicator 14 does not contain any product to be melted, its resonance frequency is different from that of the generator 13, which is fixed (for example 2.45 GHz) and the incident wave may be reflected strongly and may damage the generator. A nonreturn (circulator) device may then be inserted between the generator 13 and the applicator 14, or a device for detecting the presence or absence of the product to be melted in the applicator 14 may be provided. In the absence of the product, an automatic system will be able to reduce the transmission power of the generator 13, and this will avoid the use of a nonreturn protection circulator. All of these protection means are of known elements. The combination in series of several elementary microwave sets such as that of FIG. 3 forms the microwave device intended for melting hot-melt powders. The number of elementary sets which are combined in series obviously depends on the processing speed which is aimed at. The position of each elementary set relative to the neighboring sets is chosen so that the complete microwave device provides a practically homogeneous treatment over the entire width of the substrate to be printed. The use of a microwave device of this kind for melting hot-melt powders has shown that it enables the following advantages to be obtained:

heating of the substrate is much more selective than when an infrared treatment is employed, and is much lower overall, wave coupling to the support and to the powder is proportionately better the higher the basic weight of the substrate, treatment over the 1.40-meter width presents no problem and consumes energy of the same order of magnitude as in the case of a substrate which is much less wide (for example 70 centimeters), treatment of 50 meters per minute of a substrate of high basic weight and 1.40 meters wide would require approximately 15 kW microwaves instead of approximately 200 kW using infrared, microwaves are switched on and off instantaneously. It is therefore possible to bring the microwaves into operation only during the passage of the product through the device, and this constitutes a major energy saving and limits the heating of the applicator, and elimination of the risk of fire in the event of stoppage of the substrate due to a failure of the conveyor belt or blockage of the device.

While the invention has been shown in only one of its forms, it should be apparent to those skilled in the art that it is not so limited, but is susceptible to various changes without departing from the scope of the invention.

I claim:

1. An apparatus for producing relief printing, comprising in combination:

a printing press for printing images on printed matter with a liquid ink;

conveyor means including a conveyor belt for conveying the printed matter on the belt from the printing press while ink on the printed matter is still wet;

powdering means including a trough mounted over the conveyor belt for distributing a thermographic powder from the trough onto the wet ink on the printed matter and for sucking away from the printed matter and recycling excess powder;

microwave means including a microwave generator and a wave guide for applying microwave energy to the powder contained on the printed matter for melting the powder, the wave guide being mounted over the belt;

cooling means including a tunnel mounted over the belt and a fan for discharging air onto the printed matter to cool the powder after it has melted; and means for sensing the presence of printed matter under the wave guide, and for automatically reducing the transmission of powder from the microwave generator in the absence of printed matter.

2. An apparatus for producing relief printing, comprising in combination:

a printing press for printing images on printed matter with a liquid ink;

conveyor means including a conveyor belt for conveying the printed matter on the belt from the printing press while ink on the printed matter is still wet;

powdering means including a trough mounted over the conveyor belt for distributing a thermographic powder from the trough onto the wet ink on the printed matter and for sucking away from the printed matter and recycling excess powder;

a microwave generator;

a wave guide having one end connected to the microwave generator for distributing microwave energy from the microwave generator to the powder contained on the printed matter for melting the powder, the wave guide extending over the belt perpendicular to the belt;

a slidable end plate means mounted to an end of the wave guide opposite the end connected to the generator, the end plate means being slidable in a direction perpendicular to the belt for varying the length of the wave guide and thus the resonance of the wave guide;

the wave guide being unobstructed from the generator to the end plate means for directing microwave energy transversely across the printed matter and transversely through the powder;

cooling means including a tunnel mounted over the belt and a fan for discharging air onto the printed matter to cool the powder after it has melted; and means for sensing the presence of printed matter under the wave guide, and for automatically reducing the transmission of power from the microwave generator in the absence of printed matter.

* * * * *